US005984589A

United States Patent [19]

Ciccarello

[11] Patent Number: 5,984,589

[45] Date of Patent: Nov. 16, 1999

[54] WALL CONSTRUCTION BLOCK WITH RETAINING PIN INSERTS

[76] Inventor: Charles Ciccarello, 8750 San Francisco, Brossard, Quebec, Canada, J4X 2S7

[21] Appl. No.: 09/037,811

[22] Filed: Mar. 10, 1998

[51] Int. Cl.[6] ..... E02B 3/06

[52] U.S. Cl. ..... 405/284; 405/262; 405/273; 405/286; 52/578; 52/585.1; 52/604; 52/607

[58] Field of Search ..... 405/258, 262, 405/272, 273, 274, 286, 287; 52/685.1, 604, 605, 607, 608, 609

[56] References Cited

U.S. PATENT DOCUMENTS

| | | | |
|---|---|---|---|
| 1,566,988 | 12/1925 | Simmons et al. | 52/605 |
| 1,704,941 | 3/1929 | Hobson et al. | 405/273 |
| 2,092,385 | 9/1937 | Arble | 405/273 |
| 2,392,551 | 1/1946 | Roe | 52/586.2 |
| 4,470,728 | 9/1984 | Broadbent | 405/284 |
| 4,891,925 | 1/1990 | Carlson et al. | 52/585.1 |
| 5,480,267 | 1/1996 | Hagenah | 405/284 |
| 5,528,873 | 6/1996 | Correia et al. | 52/605 |
| 5,688,079 | 11/1997 | Boldue et al. | 405/286 |
| 5,827,015 | 10/1998 | Woolford et al. | 405/286 |
| 5,865,006 | 2/1999 | Dawson | 52/604 |

*Primary Examiner*—David Bagnell
*Assistant Examiner*—Jong-Suk Lee
*Attorney, Agent, or Firm*—Swabey Ogilvy Renault; Guy J. Houle

[57] ABSTRACT

A wall construction block for the construction of earth retaining walls includes a pair of spaced-part transverse pin receiving channels in the end walls of the block and disposed parallel to one another along respective longitudinal axis of the block which are parallel with a front face of the block. The pin receiving channels extend transverse from a top surface to a bottom surface of the block and are of substantially uniform cross-section throughout. Arresting pin elements are received in sliding fit within some of the receiving channels and are retained captive therein. Elongated parallel grooves are provided on a top surface of the block and extend across the end walls and parallel to the front wall. One of the groove is aligned between a first set of the pin receiving channels and the other of the parallel grooves is offset a predetermined distance between the other set of pin receiving channels. When the blocks are disposed in rows one on top of one another, with the top wall of the block facing upwards, the rows of blocks are arrested from transverse shifting by positioning arresting pin elements in selected ones of the sets of transverse pin receiving channels. The pins extend out of the bottom wall of the uppermost block and into a selected one of the pair of grooves in a top surface of the lower block.

15 Claims, 5 Drawing Sheets

WALL CONSTRUCTION BLOCK WITH RETAINING PIN INSERTS

TECHNICAL FIELD

The present invention relates to a wall construction block for constructing earth retaining walls and wherein the blocks are prevented from natural shifting by inserting pins transversely in an upper block to engage within a groove in a top wall of an immediately lower block.

BACKGROUND ART

It is known to provide inserts to interconnect wall constructing blocks together to construct vertical or inclined earth retaining walls. An example of such system can be found in my U.S. Pat. No. 5,528,873 issued on Jun. 25, 1996. The use of pins to interconnect blocks together in crib work which form earth retaining wall is also described in U.S. Pat. No. 2,092,385 issued on Sep. 7, 1997. However these pins provide for positive interconnection and do not permit angulation or displacement of the earth retaining block one on top of the other to form either curved walls or inclined walls or straight walls. The use of pins to interlock construction blocks is also described in U.S. Pat. No. 1,704,941 issued on Jun. 10, 1926. However, such interconnection technique cannot achieve the construction of curved walls due to the fact that the inserts are very long and maintain the blocks in fixed position. Also, because some of these blocks are provided with grooves both on the top and on the bottom surfaces thereof, the structural strength of the block is diminished, and often the blocks will become damaged when they are tumbled to give the blocks a stone-like appearance to imitate real stones. It is customary when constructing curved retaining walls that the stones be interlocked with one another.

Another disadvantage of wall construction block of the type referred in my above-referenced U.S. patent, is that the blocks need to be laid at precise positions with respect to one another and tilted at their ends whereby to position an insert partly under the block and partly projecting out of the end wall of the block in order to interconnect blocks in side-by-side relationship as well as in vertical relationship. It is also necessary to clean the grooves of any debris, such as sand, prior to the insertion of the inserts to provide proper fitting. This is particularly so when walls are being repaired and earth debris has infiltrated into the grooves with time.

SUMMARY OF INVENTION

It is a feature of the present invention to provide a wall construction block for constructing earth retaining walls which may be straight, inclined or curved walls by utilizing transverse arresting pin elements which are fitted in pin receiving channels disposed transversely in the block ends wherein blocks in adjacent rows are prevented from lateral shifting.

Another feature of the present invention is to provide a wall construction block which is simple to use in the construction of earth retaining walls and wherein the blocks may be shifted when placed on top of another block to create straight or inclined and curved earth retaining walls.

According to the above features, from a broad aspect, the present invention provides wall construction block for constructing earth retaining walls. The block has opposed parallel flat top and bottom surfaces, a front and a rear wall, and opposed flat end walls. Two space-apart transverse pin receiving channels are provided in each of the end walls and disposed parallel along longitudinal axis of the block, which axis extend parallel to the front wall. The pin receiving channels extend transverse from the top surface of the block to the bottom surface thereof. The pin receiving channels have a substantially uniform cross-section throughout and are configured to receive captive, in close fit therein, an arresting pin element. A pair of elongated parallel grooves are provided in the top surface only and extend across to the end walls and parallel to the front wall. One of the grooves is aligned between a first set of the pin receiving channels, one in each of the opposed end walls, and the other of the parallel grooves is disposed offset a predetermined distance between the other set of pin receiving channels. When the blocks are disposed in rows one on top of another with the top wall of the blocks facing upwards, the rows of blocks are arrested from transverse shifting by positioning arresting pin elements in selected ones of the set of transverse pin receiving channels. The arresting pin elements extend into a selected one of the pair of grooves in a top surface of a lower block. The pin elements also have a length no longer than the thickness of the block.

BRIEF DESCRIPTION OF DRAWINGS

A preferred embodiment of the present invention will now be described with referenced to the accompanying drawings in which.

DESCRIPTION OF PREFERRED EMBODIMENTS

Figure 1:
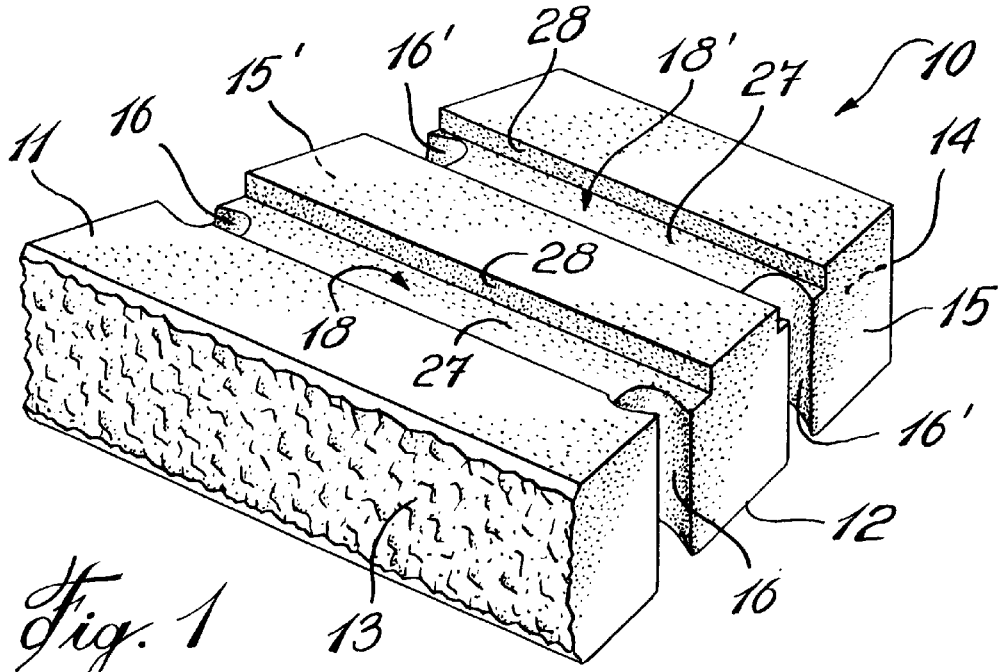
FIG. 1 is a perspective view showing a wall construction block constructed in accordance with the present invention.

Referring now to the drawings, and more particularly to FIG. 1, there is shown generally at 10, a wall construction block formed in accordance with the present invention for constructing earth retaining walls, as will be described later. The wall construction block 10 has opposed parallel flat top and bottom surfaces 11 and 12 respectively, a front wall 13 and a rear wall 14 and opposed flat end walls 15 and 15'. As herein shown the end walls 15 and 15' are inclined rearwardly whereby to provide a wall construction block 10 which may used to construct straight or curved walls which may be erected with the front faces aligned vertically or set back to construct an inclined retaining wall as will be described later with reference to FIGS. 13 and 14.

The wall construction block 10 is provided with two spaced-apart transverse pin receiving channels 16 and 16' provided in each of the end walls 15 and 15'. These pin receiving channels are disposed parallel to one another along a respective vertical axis and aligned with respect to elongated parallel grooves 18 and 18' which extend parallel to the front wall 13. The pin receiving channels 16 and 16' extend transverse from the top surface 11 of the block to its bottom surface 12.

Figure 2:
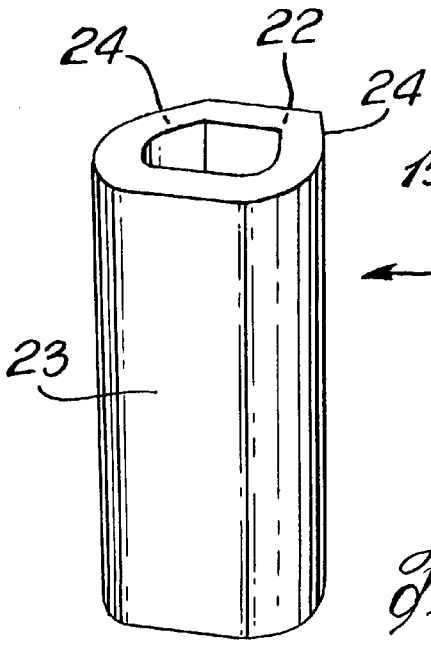
FIG. 2 is a perspective view showing the construction of the arresting pin element.
Figure 3:
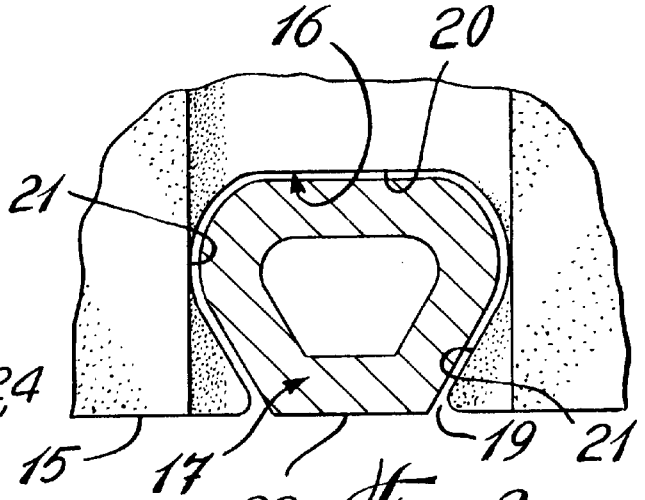
FIG. 3 is a top view of a fragmented portion of a wall construction block showing the configuration of a pin receiving channel with an arresting pin element positioned therein.
Figure 4:
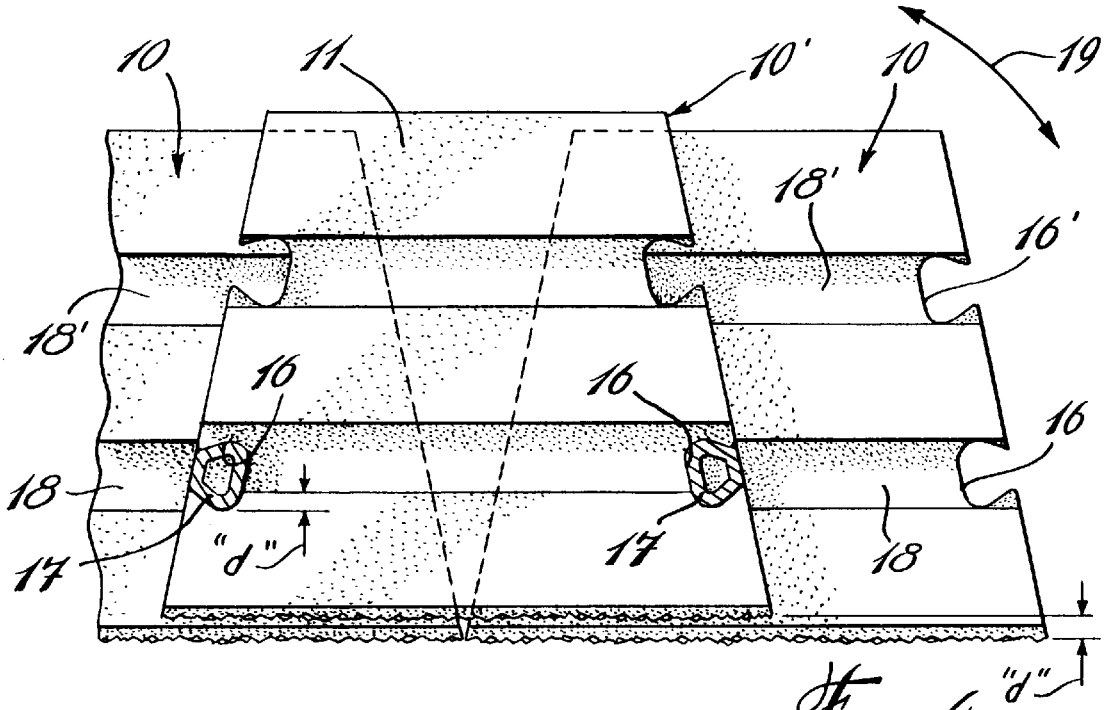
FIG. 4 is a top view, partly fragmented, showing wall construction blocks of the type illustrated in FIG. 1 laid one on top of another and interconnected with the arresting pin to construct inclined earth retaining walls.

With additional reference to FIGS. 2 to 4, it can be seen that the pin receiving channels 16 and 16' are of substantially uniform cross-section throughout and are configured to receive captive therein and in close sliding fit, an arresting pin element 17. As shown in FIG. 1, the pair of elongated parallel grooves 18 and 18' extend across to the end walls 15 and 15' of the block and are disposed parallel to the front wall.

One of the grooves, namely groove 18' is aligned between a first set of pin receiving channels, namely channels 16' disposed in the end walls, and the other of the parallel grooves, namely groove 18, is offset a predetermined distance (d) between the other set of pin receiving channels 16, as shown in FIG. 4. As also shown in FIG. 4, when the blocks 10 are disposed in rows one on top of another with their top walls 11 facing upwards, the rows of blocks are arrested from transverse shifting by positioning arresting pin elements 17 in selected ones of the set of transverse pin receiving channels. As shown in FIG. 4, the arresting pin elements 17 are positioned in the pair of channels 16 and this offsets the top block 10' the predetermined distance (d) from the bottom blocks 10. The arresting pin elements also extend downwardly into the channel 18 of the lowermost blocks 10. It can be seen that with this type of interconnection between the upper block 10' and the lower block 10, that the lower block 10 could be displaced along the arc 19 to create concave or convex curved walls as the pin connections provide pivoting of these blocks as well lateral sliding while preventing lateral shifting and therefore extremely flexible.

Figure 13:
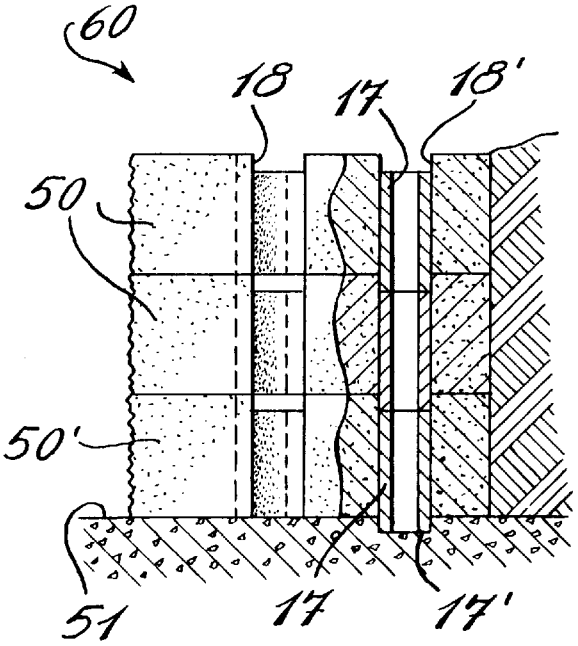
FIG. 13 is a schematic view showing an earth retaining wall constructed in accordance with the present invention and wherein the arresting pin elements are positioned in pin receiving channels to construct vertical earth retaining walls.
Figure 14:
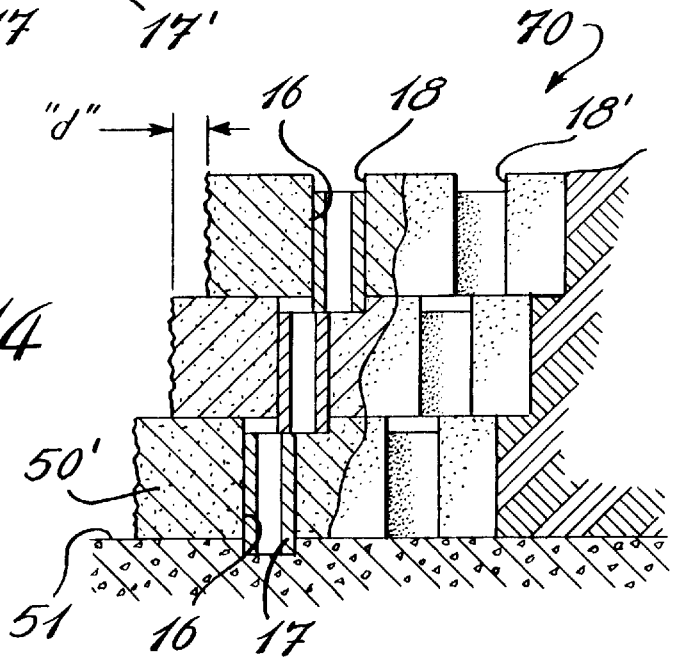
FIG. 14 is a view similar to FIG. 13 with the pins being located in pin receiving channels to construct an inclined earth retaining wall.

As shown in FIGS. 2, 13 and 14, the arresting pin elements 17 are elongated pins having a length which is no greater than the thickness of the blocks that are intended to be utilized with. These pins also have a cross-section for close sliding fit within the pin receiving channels 16 and 16'. As shown more clearly in FIG. 3, the pin receiving channels have a restricted tapered throat opening 19 which is narrower than the maximum width of the channels wherein to retain captive therein an arresting pin element 17 which is positioned from the top wall 11 of the block. The pin receiving channel also has a flat rear wall 20 which is disposed substantially parallel to the end wall 15 of the block. The channel also defines concavely curved opposed side wall portions 21 which extend from opposed edges of the restricted throat opening 19 to the bottom wall 20. The maximum width of the channel is measured across the concavely curved opposed side wall portions 21.

As can be seen from FIGS. 2 and 3, the arresting pin element 17 has an elongated tapered section which terminate at an outer narrow elongated flat face 22. They are also provided with an elongated flat rear face 23 which is disposed substantially parallel to the elongated frontal narrow flat face 22. These faces are interconnected by opposed convexly curved elongated side faces 24 which are configured to match the curved side wall portions 21 of the channels.

Figure 6:
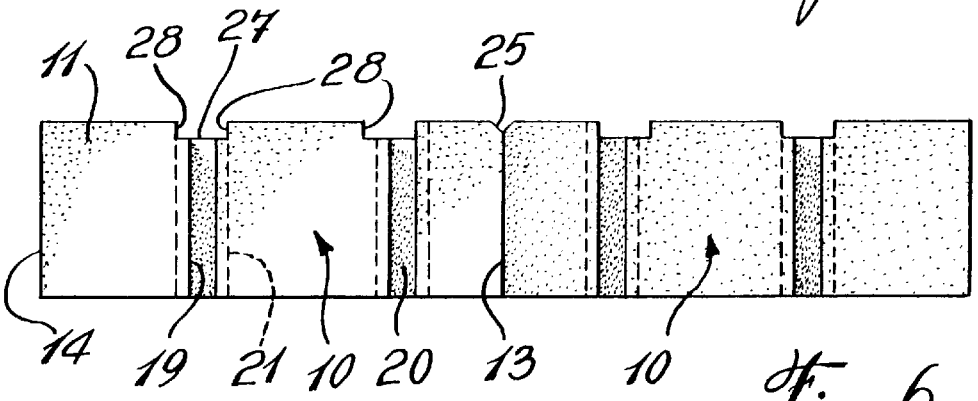
FIG. 6 is an enlarged frontal side view of FIG. 5.
Figure 5:
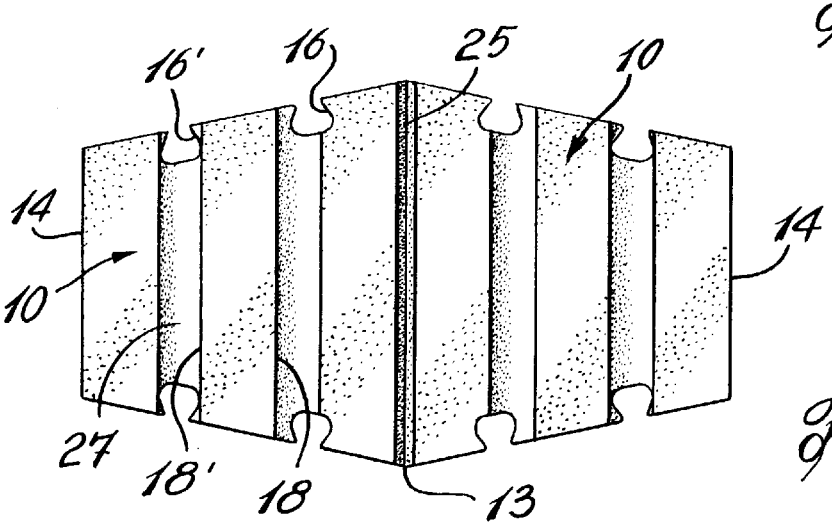
FIG. 5 is a top view, showing a method of constructing the wall construction blocks of FIG. 1 wherein a pair of these blocks are molded together.

With reference to FIGS. 5 and 6, there is shown the manner in which the wall construction block 10 of the present invention may be constructed. As herein shown two blocks 10 are molded together in a mold (not shown) and a partition groove 25 separates the two blocks 10. By positioning a masonry chisel within the groove 25, and imparting a blow thereto, the two blocks 10 are separated and the partition line 26 forms the rough front faces 13 of the blocks simulating a real stone. As also can be seen from FIGS. 1 and 6, the grooves 18 and 18' are substantially rectangular in cross-section and define a flat bottom wall 27 and opposed substantially parallel vertical side walls 28.

Figure 7:
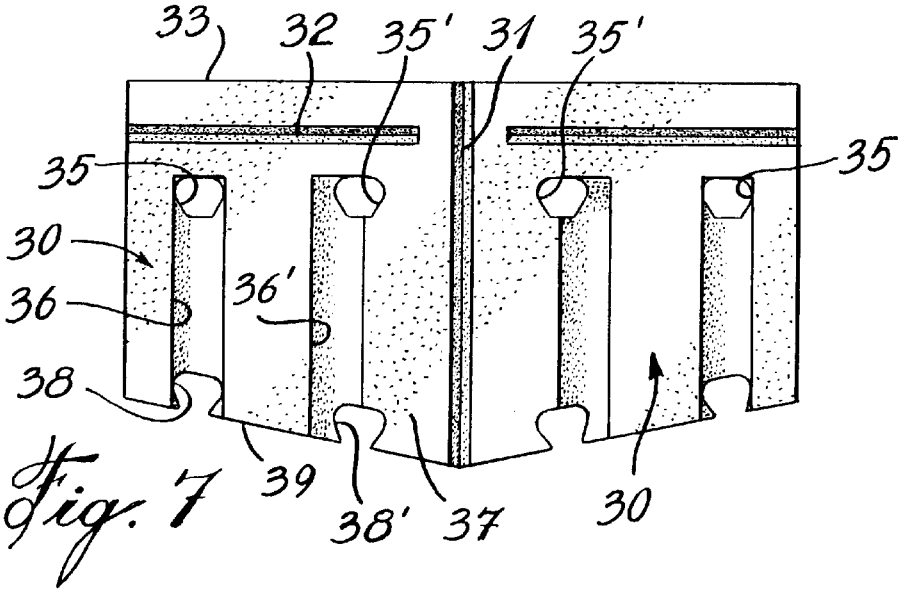
FIG. 7 is a top view showing the construction of a pair of end blocks for use with the block of FIG. 1 molded together.
Figure 8:
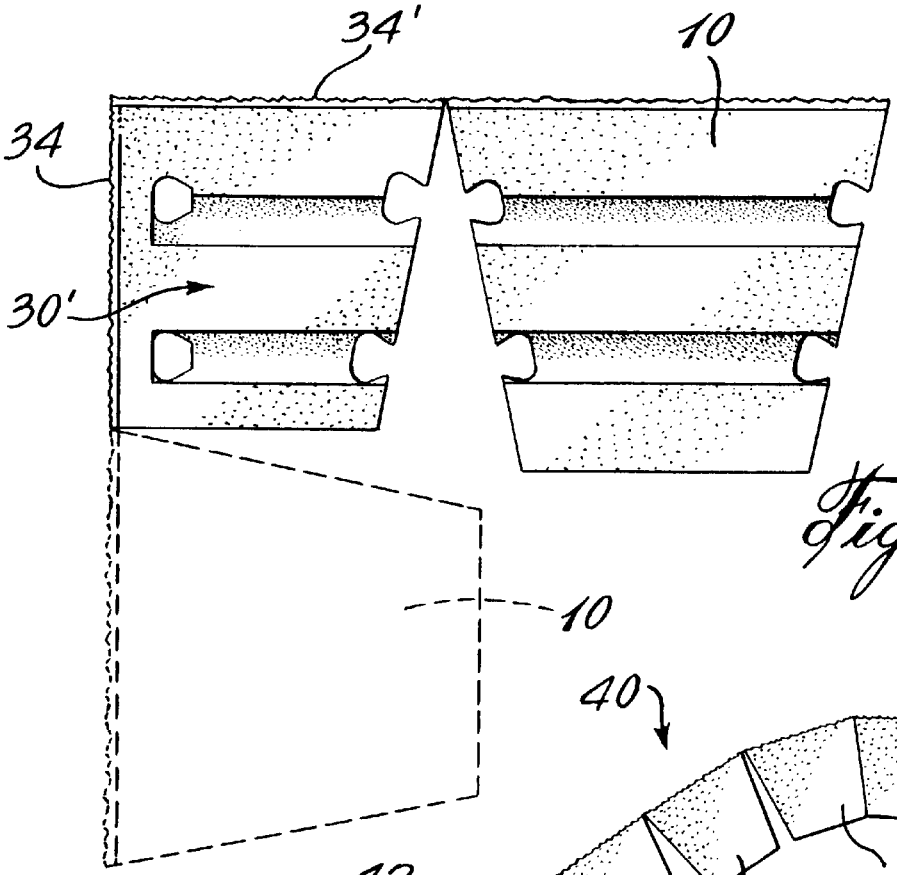
FIG. 8 is a top view showing how the end block is utilized in the construction of retaining walls with the block type of FIG. 1.

FIG. 7 is a view similar to FIG. 5 but illustrating the method of constructing a wall construction block which may be used in corners or at the ends of rows of earth retaining walls. As herein shown, a pair of blocks 30 are molded together to be separated along the partition groove 31. Additional transverse partition grooves 32 are provided in the blocks and spaced from the end walls 33 thereof. Accordingly, by placing a masonry chisel in the groove 32 and imparting a blow thereto, the block may also be formed with a rough outer surface as shown at 34 in FIG. 8 so that a corner block, such as 30' as shown in FIG. 8, may have two adjacent rough surfaces 34 and 34' exposed. In order to interlock these corner blocks 30 with lower blocks two of the receiving channels 35 are formed as through bores and spaced from the partition groove 32. These are also configured, although not shown, to receive the arresting pin element 17 therein. The walls also have parallel grooves 36 and 36' formed in the top wall 37 thereof as well as end pin receiving channels 38 and 38' in their outer end walls 39 disposed in a like manner as previously described. As can be seen the through bore 35' and the pin receiving channel 38' are offset from the groove 36'.

Figure 9:
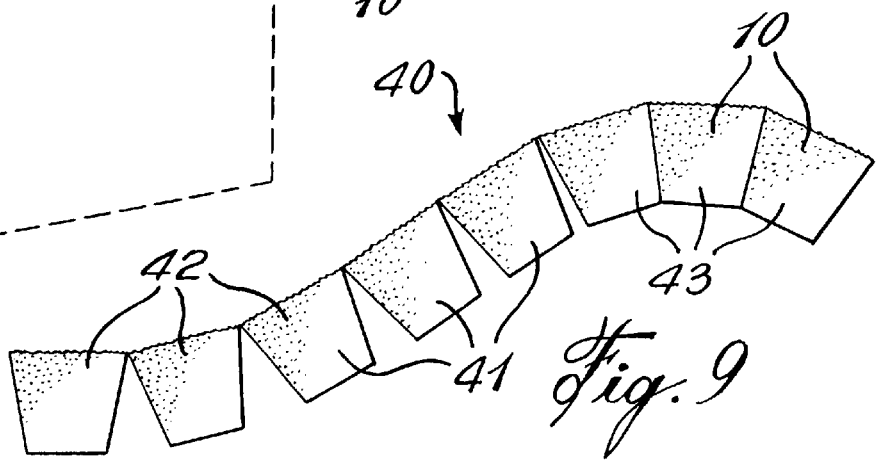
FIG. 9 shows how curved walls may be constructed with the block of FIG. 1.
Figure 10:
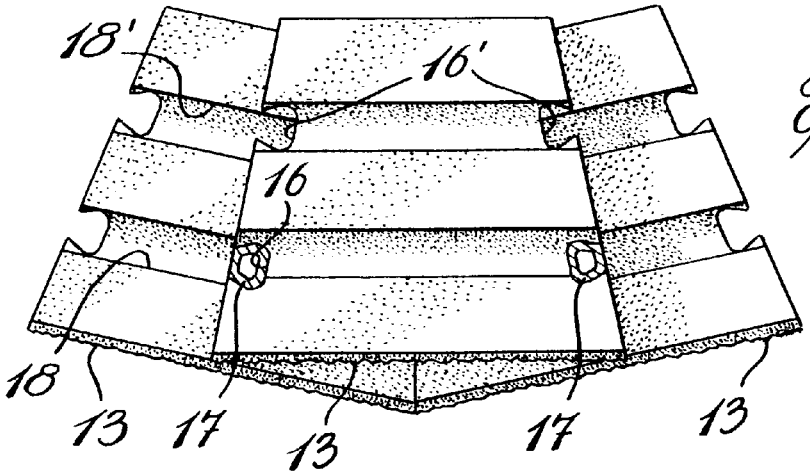
FIG. 10 shows the block of FIG. 1 laid one on top of another for the construction of curved retaining walls which may also be inclined.

FIG. 9 is a schematic diagram showing a curved earth retaining wall 40 constructed with the blocks 10 of the present invention. As herein shown, the blocks may be positioned either in a straight line as shown at 41, or in a concavely curved manner, as shown at 42, or in a convexly curved manner, as shown by the blocks at 43. Also, as shown in FIG. 10, the blocks may be connected offset to construct a rearwardly inclined wall by positioning the arresting pin elements 17 in the forward pin receiving channels 16. If the wall is to be constructed with the front faces 13 of the blocks aligned in a substantial vertical plane, then the pins 16 would be positioned in the rear pin receiving channels 16' and extend to the rear groove 18' of the lower blocks 10.

With reference now to FIG. 1, there is shown another wall construction block, herein block 50 constructed in accordance with the present invention. As herein shown the block 50 is an elongated rectangular block having parallel end walls 51 in which the pin receiving channels 16 and 16' are disposed. The elongated parallel grooves 18 and 18' are disposed in a like manner to the blocks as described in FIG. 1 and everything else in this construction is the same.

Figure 12:
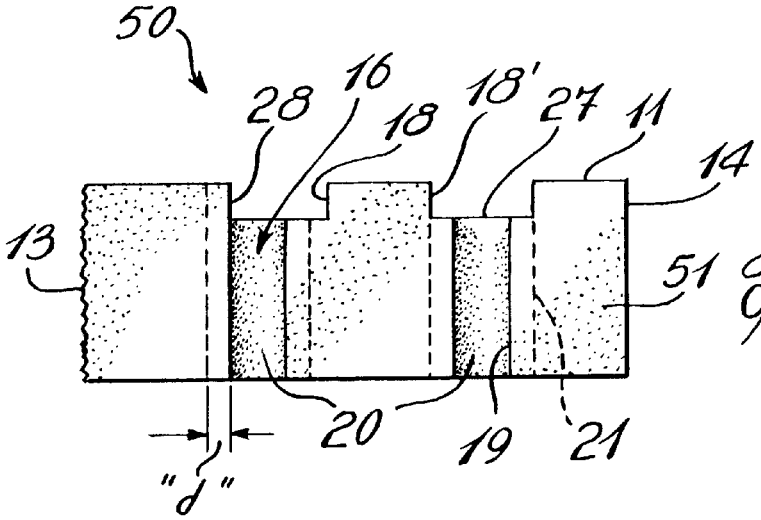
FIG. 12 is an end view of FIG. 11.

FIG. 12 provides a clear illustration showing the position of the transverse pin receiving channels 16 and 16' and their restricted throat opening 19 and how these are disposed parallel to the front and rear walls 13 and 14 of the block 50. It also illustrates the offset distance (d) of the frontal groove 18 with respect to the pin receiving channels 16 and 16'.

Figure 11:
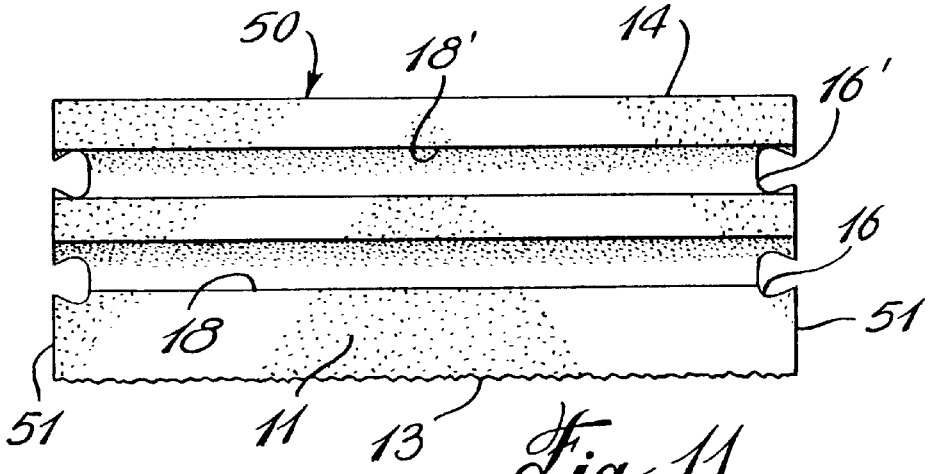
FIG. 11 is a top view of a rectangular wall construction block constructed in accordance with the present invention.

FIGS. 13 and 14 show how vertical earth retaining wall 60 and inclined earth retaining wall 70 are constructed. As shown in FIG. 13, in order to construct vertical earth retaining walls with the block 50 of FIG. 11, a first block 50' is positioned on a ground surface 51 and a pin 17' is positioned in the rear pin receiving channel 16'. The pin 17 may be driven into the ground surface as shown at 17'. Alternatively, the pin 17 may be of a shorter length for the starting rows of blocks 16'. However, by driving the pin into the ground, some form of anchoring is achieved and it may also be advantageous to drive longer pins having pointed ends into the ground for the starter row to provide a more positive anchoring of the lower course. Of course, the pin needs to be driven into the ground a distance sufficient so that the top end of the pin 17 is flush with or lower than the flat bottom wall 27 of the channel 18. As subsequent rows of blocks 50 are laid upon the bottom row of blocks 50', these blocks are offset longitudinally from one another, as is well known in the art, as the pins 17 will enter the channel 18' of the lower block to prevent lateral shifting of the blocks while providing an interconnection thereof.

When constructing inclined walls, as shown in FIG. 14, the pins 17 are located in the frontal set of pin receiving channels 16 and the same procedure as with respect to FIG. 13 is repeated with the exception that alternate rows of blocks 50 are offset a distance (d), as illustrated herein.

Figure 15:
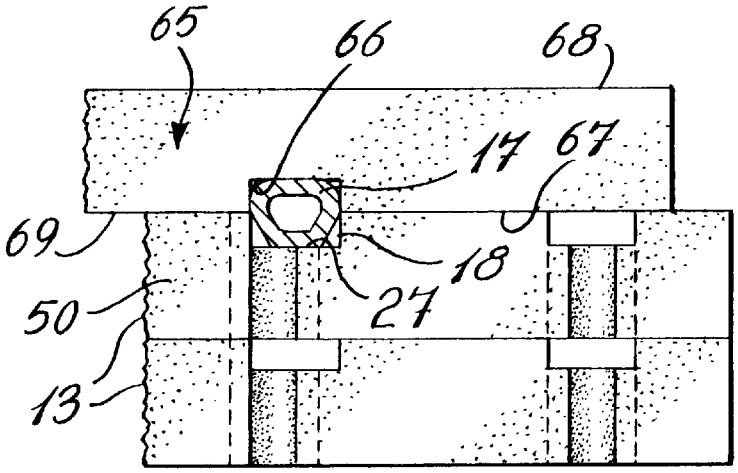
FIG. 15 is a schematic end view showing how a cap type block is secured over the uppermost wall construction block of a earth retaining wall utilizing the arresting pin element forming part of the present invention.

FIG. 15 shows the use of the arresting pin elements 17 for interconnecting a cap block 65 to the top row of blocks 50. As herein shown the cap block 65 is provided with an elongated groove 66 in its lower face 67. The top surface 68 of the cap block 65 is does not have of any groove. Further, although not shown, the groove may not extend to the end walls whereby the end walls may be solid end walls. The cap blocks 65 are interconnected by positioning the arresting pin elements 17 longitudinally within the flat top surface 27 of the frontal groove 18. Accordingly, the cap block 65 is prevented from lateral shifting while projecting beyond the front surface 13 of the lower block 50 a predetermined distance, as shown at 69.

Although the preferred embodiment of the present invention has been herein explained with reference to two different types of blocks, it is to be understood that the invention is not limited thereto and details of construction of other form of blocks is intended to be covered herein. It is to be understood that the invention is capable of other embodiments and of being practiced and carried out in various ways. It is to be understood that the phraseology and terminology employed herein are for the purpose of description and should not be regarded as limiting.

As such, those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

I claim:

1. A wall construction block for constructing earth retaining walls, said block having opposed parallel flat top and bottom surfaces, a front and a rear wall, and opposed flat end walls, two spaced-apart transverse pin receiving channels in each said end walls disposed parallel to one another and positioned in alignment with respective longitudinal axis of the block parallel to said front wall, said pin receiving channels extending transverse from said top surface to said bottom surface, said pin receiving channels having a substantially uniform cross-section throughout and configured to receive captive therein an arresting pin element in close sliding fit, and a pair of elongated parallel grooves in said top surface only and extending across to said end walls and parallel to said front wall, one of said grooves being aligned between a first set of said pin receiving channels one in each of said opposed end walls and the other of said parallel grooves being offset a predetermined distance between the other set of said pin receiving channels in said opposed end walls, whereby when said blocks are disposed in rows one on top of another with said top surface facing upwards, said rows of blocks are arrested from transverse shifting by positioning said arresting pin elements in selected ones of said sets of transverse pin receiving channels, said arresting pin elements extending into a selected one of said pair of grooves in a top surface of a lower block, said pin elements having a length no greater than the thickness of said block.

2. A wall construction block as claimed in claim 1 wherein said pin receiving channels have a restrictive tapered through opening which is narrower than the maximum width of said channels wherein to retain captive on said arresting pin element positioned in sliding fit therein from said top surface of said block.

3. A wall construction block as claimed in claim 2 wherein said pin receiving channels each have a flat rear wall disposed substantially parallel to said end walls.

4. A wall construction block as claimed in claim 2 wherein said pin receiving channels each have concavely curved opposed side wall portions extending from opposed edges of said restrictive throat opening to a bottom vertical wall of said channels.

5. A wall construction block as claimed in claim 4 wherein said bottom vertical wall is a flat rear wall disposed substantially parallel to said end walls, said pin receiving channels having a maximum width as measured across said concavely curved opposed side wall portions which is substantially equal to the width of said groove.

6. A wall construction block as claimed in claim 2 in combination with said arresting pin elements, for the construction of earth retaining walls, said arresting pin elements being elongated straight pins, each said pins when viewed in cross-section having a configuration for sliding fit in said pin receiving channels and defining a tapered section.

7. A wall construction block as claimed in claim 6 wherein said tapered section defines an outer narrow elongated flat face along each said pins, said pins each having an elongated flat rear face disposed substantially parallel to said outer narrow elongated flat face, and opposed convexly curved elongated side faces.

8. A wall construction block as claimed in claim 7 wherein when one of said pins is positioned in one of said first set of pin receiving channels of an upper block, said pin extends into a rear one of said pair of grooves in said top surface of an immediately lower block wherein to align said front wall of said upper block and said immediately lower block in a common plane.

9. A wall construction block as claimed in claim 7 wherein when one of said pins is positioned in one of said other set of pin receiving channels of an upper block, said pin extends into a forward one of said pair of grooves in said top surface of an immediately lower block wherein to offset said front wall of said upper block and said immediately lower block.

10. A wall construction block as claimed in claim 6 wherein said pin elements are disposed in selected ones of said pin receiving channels of said wall construction blocks when superimposed one on top of each other to construct earth retaining walls which are straight or curved and wherein said front wall of said blocks may be aligned in a common plane or offset to form a vertically inclined retaining wall.

11. A wall construction block as claimed in claim 1 wherein said parallel grooves are of substantially rectangular cross-section and define a flat bottom wall and opposed substantially parallel vertical side walls.

12. A wall construction block as claimed in claim 1 wherein said other of said parallel grooves is offset rearwardly of said other set of said pin receiving channels in said opposed end walls.

13. A wall construction block as claimed in claim 12 wherein said other of said parallel grooves is a forward one of said pair of elongated parallel grooves.

14. A wall construction block as claimed in claim 1 wherein said end walls are rearwardly inclined flat end walls.

15. A wall construction block as claimed in claim 1 wherein said end walls are straight parallel flat end walls.

* * * * *